US010071318B1

(12) United States Patent
Bagumyan et al.

(10) Patent No.: US 10,071,318 B1
(45) Date of Patent: Sep. 11, 2018

(54) SLIDE WITH RETRACTABLE BUMPER

(71) Applicants: Sarmen Bagumyan, Glendale, CA (US); Arthur Bagumyan, Glendale, CA (US); Andranik Andy Bagumyan, Glendale, CA (US)

(72) Inventors: Sarmen Bagumyan, Glendale, CA (US); Arthur Bagumyan, Glendale, CA (US); Andranik Andy Bagumyan, Glendale, CA (US)

( * ) Notice: Subject to any disclaimer, the term of this patent is extended or adjusted under 35 U.S.C. 154(b) by 0 days.

(21) Appl. No.: 15/637,149

(22) Filed: Jun. 29, 2017

(51) Int. Cl.

| | |
|---|---|
| ***A63G 21/00*** | (2006.01) |
| ***A63G 31/12*** | (2006.01) |
| ***A63G 21/18*** | (2006.01) |
| *A63G 31/00* | (2006.01) |

(52) U.S. Cl.
CPC ..... *A63G 31/12* (2013.01); *A63G 21/18* (2013.01); *A63G 31/007* (2013.01)

(58) Field of Classification Search
CPC ..... A63G 21/00; A63G 21/18; A63G 31/00; A63G 31/02; A63G 31/12
USPC ..... 472/116–117, 134; 104/69–70
See application file for complete search history.

(56) References Cited

U.S. PATENT DOCUMENTS

| | | | | |
|---|---|---|---|---|
| 5,401,214 | A * | 3/1995 | Smollar | A63G 21/18 446/489 |
| 6,322,454 | B1 * | 11/2001 | Gordon | A63B 69/0048 472/134 |
| 6,648,767 | B1 * | 11/2003 | Chen | A63G 21/18 472/117 |
| 7,300,354 | B2 | 11/2007 | Fields | |
| 2007/0072690 | A1 * | 3/2007 | Berenson | A63G 21/00 472/117 |

* cited by examiner

*Primary Examiner* — Kien Nguyen
(74) *Attorney, Agent, or Firm* — Eric Karich; Karich & Associates

(57) ABSTRACT

A slide system has a base inflatable structure capable of sustaining an air pressure, and a slide surface supported by the base inflatable structure. A lower slide flap forms a bottom end of the slide surface, and a lower slide support of the base inflatable structure supports the lower slide flap. A bumper body receives air pressure from the base inflatable structure to inflate to form a protrusion that extends upwardly from the lower slide support when inflated. A restraint structure restrains the bumper body to a flattened configuration, but when the restraint structure is released, the bumper body inflates to form the protrusion that forms a bumper at the bottom of the slide.

9 Claims, 5 Drawing Sheets

SLIDE WITH RETRACTABLE BUMPER

BACKGROUND OF THE INVENTION

Field of the Invention

This invention relates generally to inflatable slides, and more particularly to an inflatable slide having a retractable bumper at a bottom of the slide which may be raised or lowered as desired by the user.

Description of Related Art

Various forms of inflatable slides are known in the prior art. For example, Field, U.S. Pat. No. 7,300,354, teaches an inflatable slide that includes stairs for climbing to the top of the inflatable housing, and an adjacent slide portion for sliding back down. The slide portion is integrally formed with the rest of the structure, and cannot be adjusted.

Other prior art slides have integral bumpers at the bottom, to prevent a user from sliding completely off the slide and potentially being hurt. These slides are particularly useful when younger children are using the slide, due to the need for greater safety. However, the bumper cannot be removed, and the inability to remove the bumper prevents some uses of the slide, such as connecting the slide with other inflatables.

The prior art teaches inflatable slides, either with a bumper or without. However, the prior art does not teach an inflatable slide that includes a bumper system that allows the bumper to be raised or lowered, depending upon the use of the slide. The present invention fulfills these needs and provides further advantages as described in the following summary.

SUMMARY OF THE INVENTION

The present invention teaches certain benefits in construction and use which give rise to the objectives described below.

The present invention provides a slide system that includes a base inflatable structure capable of sustaining an air pressure, and a slide surface supported by the base inflatable structure. A lower slide flap forms a bottom end of the slide surface, and a lower slide support of the base inflatable structure supports the lower slide flap. An aperture in the lower slide support, beneath the bottom end of the slide surface, allows air to flow into a bumper body that receives the air pressure from the base inflatable structure to inflate to form a protrusion that extends upwardly from the lower slide support when inflated. A restraint structure restrains the bumper body to a flattened configuration, but when the restraint structure is released, the bumper body inflates to form the protrusion that creates a bumper at the bottom of the slide.

A primary objective of the present invention is to provide a slide system having advantages not taught by the prior art.

Another objective is to provide a slide system that includes a retractable bumper that may be raised to prevent a user from sliding off the end of the slide, or lowered to leave the end of the slide unobstructed.

A further objective is to provide a slide system that may be quickly and easily converted between the two different configurations, without requiring tools or extensive changes or additional parts.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a slide system that includes a retractable bumper at the bottom of the slide which may be raised or lowered, depending upon whether the bumper is desired or not.

Figure 1:
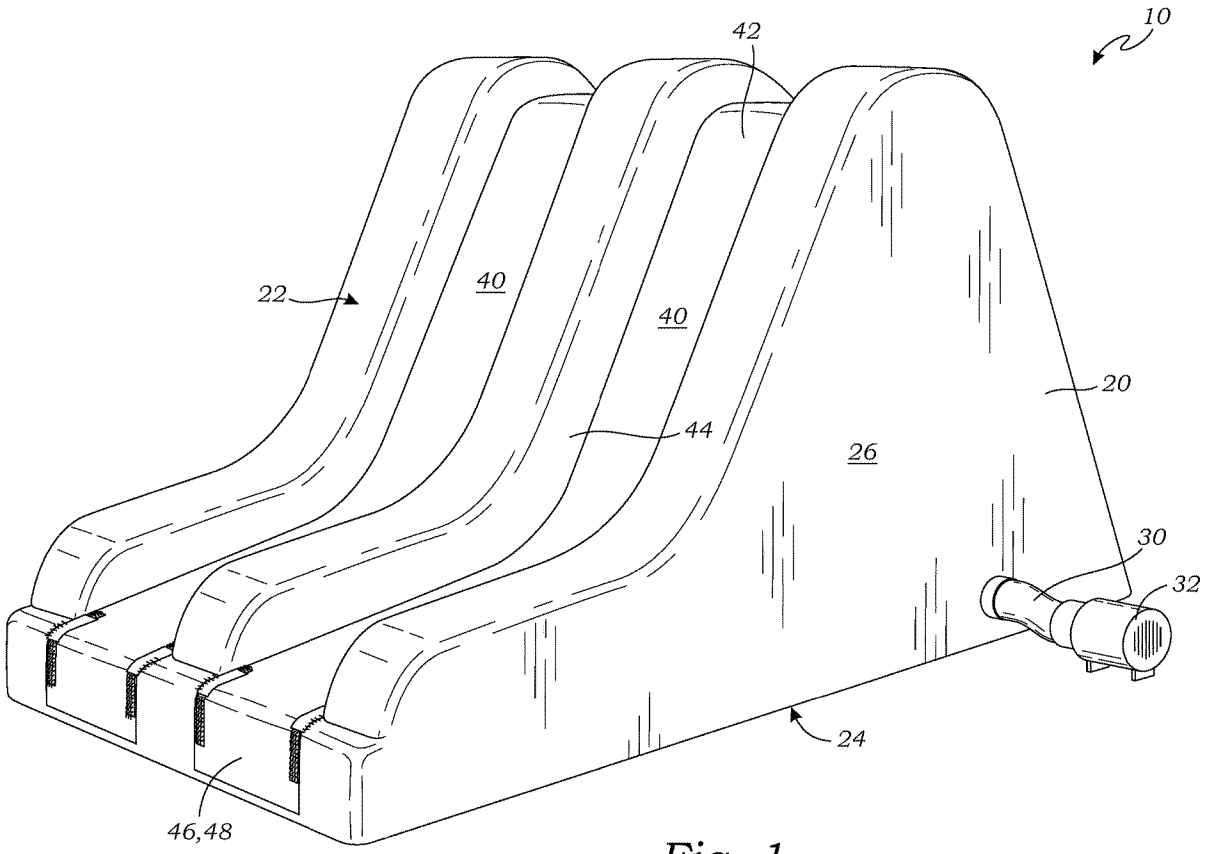
FIG. 1 is a perspective view of a slide system according to one embodiment of the present invention, illustrating a bumper portion of the slide system in a lowered position.
Figure 6:
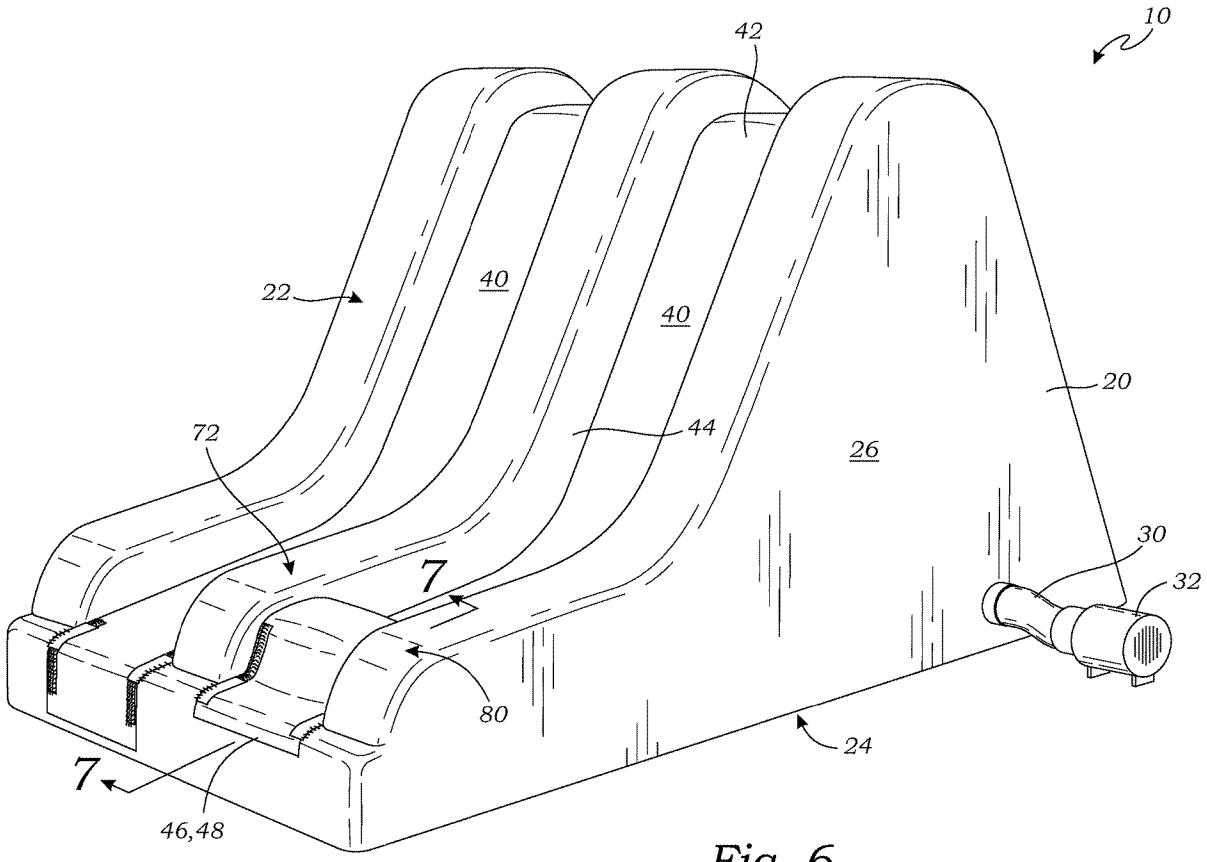
FIG. 6 is a perspective view of the slide system with the lower slide flap down over the inflated bumper portion.

FIG. 1 is a perspective view of a slide system 10 according to one embodiment of the present invention. FIG. 1 illustrates the slide system 10 wherein the retractable bumper is in a flattened configuration so that the bottom of the slide is not obstructed. The retractable bumper 80 is in a raised configuration is illustrated in FIG. 6, as discussed in greater detail below. No tools are typically required to raise or lower the bumper 80, and the conversion is quick and easy, typically taking less than a minute to make the conversion.

As shown in FIG. 1, the slide system 10 includes a base inflatable structure 20 capable of sustaining an air pressure. While one embodiment of the base inflatable structure 20 is illustrated, those skilled in the art may devise a wide range of such structures, and any desired form may be used pursuant to the teachings of the present invention. In the present embodiment of FIG. 1, the base inflatable structure 20 includes a top structure 22 that is adapted to provide at least one slide surface 40, as discussed in more detail below, and an opposed bottom portion 24, connected via side walls 26, which together form a three dimensional structure which may be inflated. The slide surface 40 may be formed in many different configurations, and may include one or more slides (in this embodiment, two slides), and may further include any other structures known in the art (e.g., stairs or ladders, a bouncy house, etc., not shown).

The base inflatable structure 20 includes an air supply tube 30 that enables the base inflatable structure 20 to receive air from a blower 32, to inflate the base inflatable structure 20. The air supply tube 30 is typically a flexible, generally cylindrical structure, commonly constructed of a suitable flexible material such as polyvinyl chloride (PVC), textile-reinforced urethane plastic or rubber, or other suitable material known in the art. In alternative embodiments, the air supply tube 30 may be constructed of a rigid plastic, or other material desired by one skilled in the art. Any form of inflation mechanism known in the art may be utilized, and should be considered within the scope of the present invention.

Figure 2:
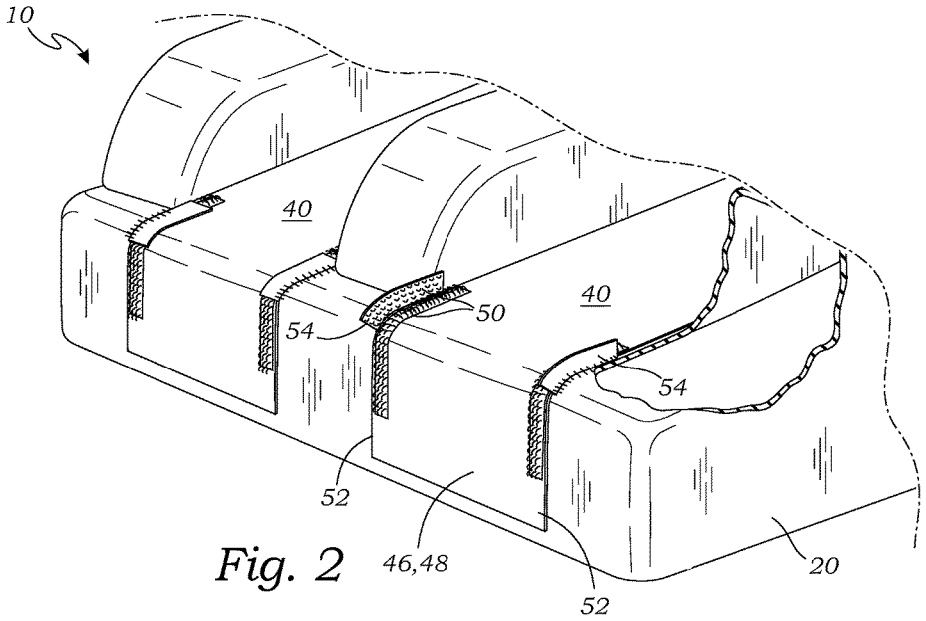
FIG. 2 is a close-up perspective view of a bottom end of the slide system.
Figure 3:
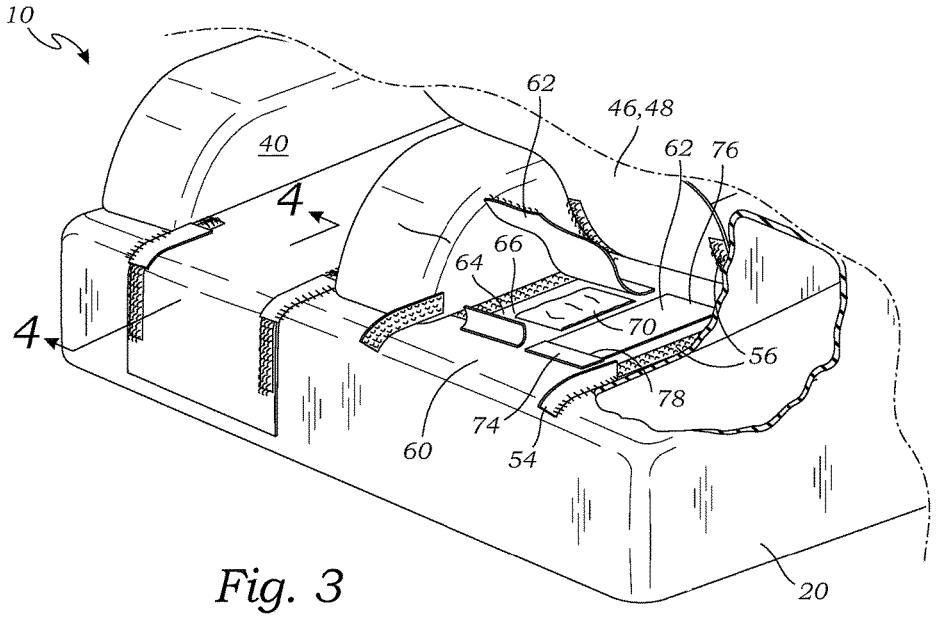
FIG. 3 is a close-up perspective view of a bottom end of the slide system once a lower slide flap has been raised, illustrating a restraint structure, and a bumper body in a collapsed configuration.

FIG. 2 is a close-up perspective view of a bottom end 46 of the slide system 10. FIG. 3 is a similar perspective view, illustrating a lower slide flap 48 raised to expose a restraint structure 62, and a bumper body 70 in a collapsed configuration. As shown in FIGS. 1-3, the slide system 10 includes a slide surface 40 supported by the base inflatable structure 20. The slide surface 40 extends from a top end 42 at the top of the slide system 10, down an incline 44, to a bottom end 46.

The slide surface 40 may be constructed of a material that has a coefficient of friction that is suitable for sliding (i.e., for a person to slide down the slide). In some embodiments this may be formed of a plastic, rubber, or rubberized material, but any materials known in the art may be used, and should be considered within the scope of the present invention. The slide surface 40 may be adapted for use while dry, and/or with water (i.e., as a water slide), or in any other manner known in the art. Since those skilled in the art know suitable materials used for this purpose, it is not described in greater detail herein.

In one embodiment, the slide surface 40 is formed by a sheet of suitable material that is positioned over the base inflatable structure 20. In the present embodiment, the entire slide surface 40 is in the form of a separate elongate sheet that is supported upon the base inflatable structure 20. However, in an alternative embodiment, at least part of the slide surface 40 may be integrally formed as part of the base inflatable structure 20, with only a lower portion of the slide being formed of a separate sheet of material, such that the bottom end 46 is formed by a lower slide flap 48 that is separate from the base inflatable structure 20. The lower slide flap 48 may be lifted for adjusting the bumper 80 (shown in FIG. 6) installed under the slide surface 40, as discussed in greater detail below.

As best shown in FIG. 2, the slide system 10 includes one or more fasteners for fastening the lower slide flap 48 to the base inflatable structure 20. While any suitable fasteners known in the art may be used, in this embodiment the fasteners are hook and loop fasteners, commonly known as VELCRO®. In this embodiment, the fasteners include upper side edge fasteners 50 for removably connecting side edges 52 of the lower slide flap 48 of the locking flap 54 that is pivotally connected to the lower slide support 60 of the base inflatable structure 20, such that the locking flap 54 extends over the lower slide flap 48 and fastens the lower slide flap 48 in place. In FIG. 2, the left side slide shows the upper side edge fasteners 50 in a locked position, while the right side slide shows the upper side edge fasteners 50 lifted in preparation of raising the lower slide flap 48.

Figure 4:
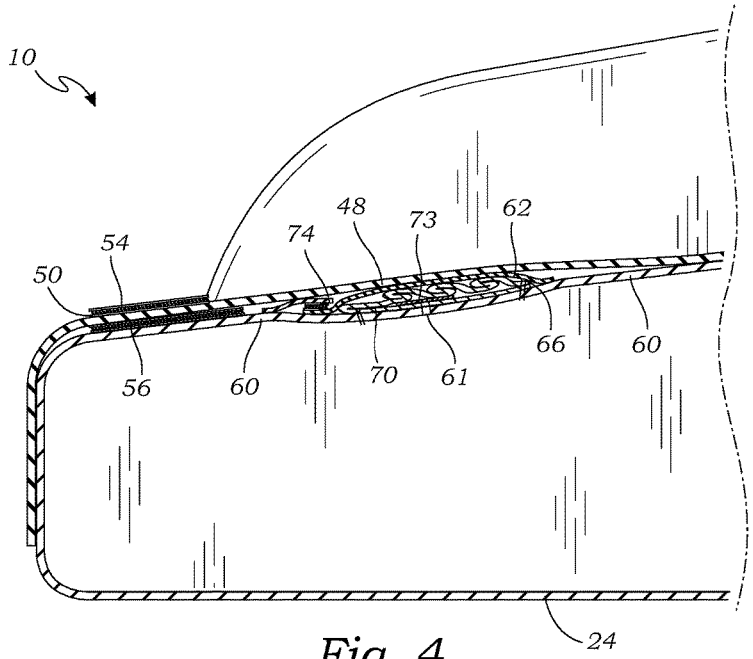
FIG. 4 is a sectional view thereof taken along line 4-4 in FIG. 3.

FIG. 3 is a close-up perspective view of the bottom end 46 of the slide system 10 once the lower slide flap 48 has been raised, illustrating a restraint structure 62, and a bumper body 70 in a collapsed configuration. FIG. 4 is a sectional view thereof taken along line 4-4 in FIG. 3. As shown in FIGS. 3 and 4, the slide system 10 further includes lower side edge fasteners 56 for removably connecting side edges 52 of the lower slide flap 48 to the lower slide support 60 of the base inflatable structure 20. The lower side edge fasteners 56 may be hooks and loops fasteners, as shown, or any other suitable fasteners selected by one skilled in the art. FIG. 3 also shows other components of the invention, as discussed in greater detail below.

Figure 5:
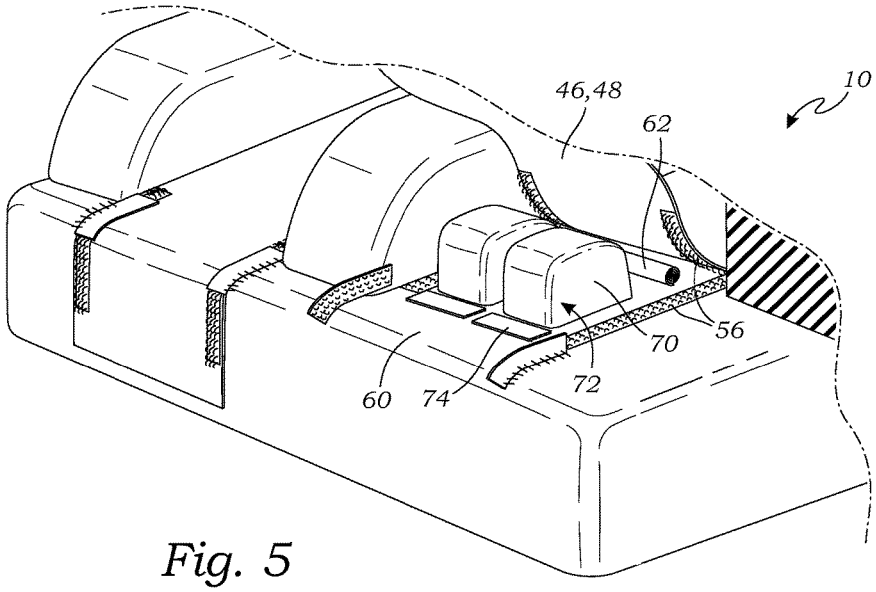
FIG. 5 is a close-up perspective view of a bottom end of the slide system with the lower slide flap still raised as in FIG. 3, illustrating the bumper bodies once they have been inflated.
Figure 7:
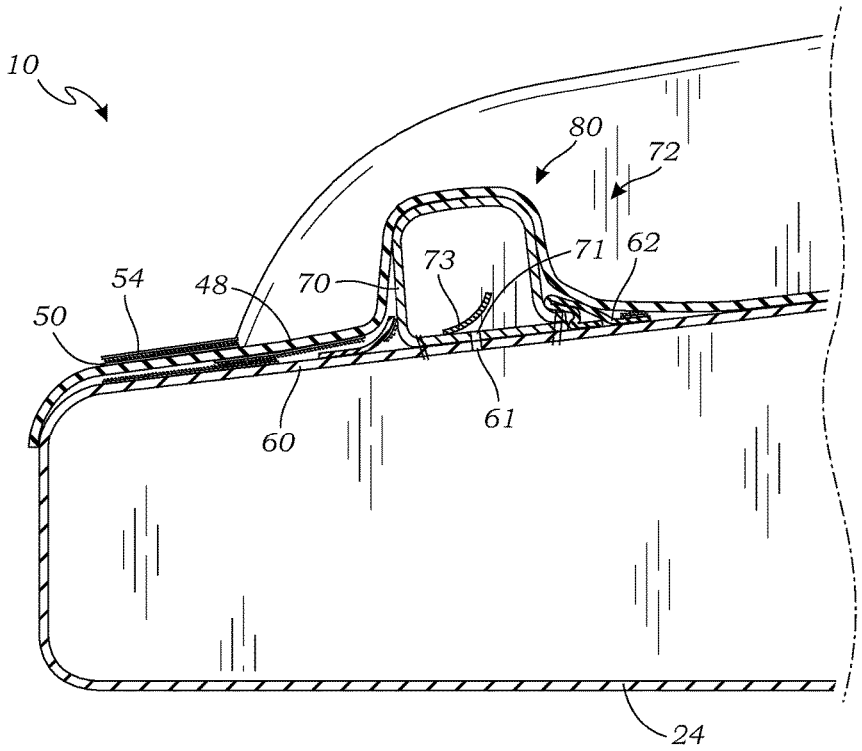
FIG. 7 is a sectional view thereof taken along line 7-7 in FIG. 6.

As shown in FIGS. 3 and 4, the slide system 10 includes a bumper body 70 that may form a protrusion 72 (as shown in FIGS. 5 and 7), and a restraint structure 62 that covers or otherwise restrains the bumper body 70. FIGS. 3 and 4 illustrate a pair of these bumper bodies 70, with one being covered by the restraint structure 62, and the other having been uncovered, but which has not yet inflated. The inflation of the bumper body 70 is shown in FIGS. 5 and 7, as discussed in greater detail below.

FIG. 5 is a close-up perspective view of the bottom end 46 of the slide system 10 with the lower slide flap 48 still raised as in FIG. 3, illustrating the bumper bodies 70 once they have been inflated. FIG. 6 is a perspective view of the slide system 10 with the lower slide flap 48 down over the inflated bumper 80 portion. FIG. 7 is a sectional view thereof taken along line 7-7 in FIG. 6.

As shown in FIGS. 3-7, the base inflatable structure 20 includes a lower slide support 60 that is shaped to support the lower slide flap 48. In this embodiment, the base inflatable structure 20 includes an aperture 61 beneath the lower slide flap 48. The aperture 61 may be small, as illustrated, or of other size and/or shape, and any number of apertures 61, of any suitable shape, may be used.

In this embodiment, the bumper body 70 is attached (e.g., sewn, welded, integrally formed with, or otherwise fastened, using any method known in the art) over the aperture 61 to receive the air pressure from the base inflatable structure 20 to inflate to form a protrusion 72 (as shown in FIGS. 5 and 7) that extends upwardly from the lower slide support 60 when inflated. The bumper body 70 may be constructed of a sheet of flexible material, so it can be collapsed to a flattened configuration (as shown in FIGS. 3 and 4) that does not extend upwardly from the lower slide support 60.

In this embodiment, the bumper body 70 includes a bumper aperture 71 (e.g., hole, slit, or other form of opening) that is positioned over the aperture 61 so as to not obstruct the aperture 61. A flap 73 is positioned over the aperture 61 (and bumper aperture 71) so that it may close the aperture 61 so that air does not flow out of the bumper body 70 when it is impacted by a user.

In the embodiment of FIGS. 4-7, the restraint structure 62 is in the form of a sheet that covers or otherwise restrains the bumper body 70 and may be removably attachable to the base inflatable structure 20 with a fastener 74 such that the restraint structure 62 contains the bumper body 70 in the flattened configuration. In this flattened configuration, as shown in FIG. 4, the flap 73 is compressed down to cover the aperture 61 (and/or bumper aperture 71) and prevent inflation. As shown in FIG. 7, when the restraint structure 62 is released, the bumper body 70 is able to inflate, in which case the flap 73 opens to allow inflation (as shown), and then closes to prevent deflation.

As shown in FIG. 7, the restraint structure 62 may be readily unfastened and moved, to allow the bumper body 70 to inflate to form the protrusion 72. In the present embodiment, the restraint structure 62 is in the form of a sheet or similar form of flap; however, while one embodiment of the restraint structure 62 is illustrated herein, those skilled in the art may devise other structures and methods for restraining the bumper body 70 in a similar manner (e.g., straps, hooks, other forms of fasteners), or via equivalent means (e.g., a valve to control air flow into the bumper body 70), and such alternative should be considered within the scope of the present invention.

FIGS. 3 and 4 illustrate one of a pair of the restraint structures 62 in the form of a flap that is fastened with the fastener 74 (e.g., hooks and loops, or any other suitable fastener known in the art) to hold the bumper body 70 in the collapsed configuration, while the other restraint structure 62 is lifted up to reveal the bumper body 70. Once the bumper body 70 is released, as shown in FIG. 3, it inflates to form the protrusion 72, as shown in FIGS. 5 and 7. The effect of this inflation is shown in FIG. 6, wherein the slide includes the bumper 80 at the bottom.

As shown in FIG. 1, the slide surface 40 is substantially flat when the restraint structure 62 maintains the bumper body 70 in the flattened configuration. This enables the slide system 10 to be used as a regular slide. However, as shown in FIG. 6, when the restraint structure 62 is removed, the slide surface 40 is pushed upwardly by the protrusion 72 of the bumper body 70, thereby forming a bumper 80 at the bottom end 46 of the slide surface 40, and preventing smaller children from going completely off of the slide.

As shown in FIG. 3, the restraint structure 62 may be in the form of a flexible flap or sheet that is sewn (or otherwise fastened to) on one edge 76 to the lower slide support 60 of the base inflatable structure 20, and an opposing edge 78 includes the fastener 74 for fastening the restraint structure 62 to the lower slide support 60 of the base inflatable structure 20.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A slide system comprising:

a base inflatable structure capable of sustaining an air pressure;

a slide surface supported by the base inflatable structure, the slide surface having a top end and extends on an incline to a bottom end, and is constructed of a material that has a coefficient of friction that is suitable for sliding;

a lower slide flap that is separate from the base inflatable structure and forms the bottom end of the slide surface;

a lower slide support of the base inflatable structure that is shaped to support the lower slide flap;

an aperture in the lower slide support, beneath the bottom end of the slide surface;

a bumper body that is attached over the aperture to receive the air pressure from the base inflatable structure to inflate to form a protrusion that extends upwardly from the lower slide support when inflated, but which is flexible enough to be collapsed to a flattened configuration;

a restraint structure that restrains the bumper body and is removably attachable to the base inflatable structure with a fastener such that the restraint structure contains the bumper body in the flattened configuration when the bumper body is covered by the restraint structure, but such that the restraint structure is adapted to be unfastened to allow the bumper body to inflate to form the protrusion; and wherein the slide surface is substantially flat when the restraint structure maintains the bumper body in the flattened configuration, but the slide surface is pushed upwardly by the protrusion of the bumper body when the restraint structure is moved to enable the bumper body to inflate.

2. The slide system of claim 1, further comprising lower side edge fasteners for removably connecting side edges of the lower slide flap to the lower slide support of the base inflatable structure.

3. The slide system of claim 1, further comprising upper side edge fasteners for removably connecting side edges of the lower slide flap to a locking flap that is pivotally connected to the lower slide support of the base inflatable structure, such that the locking flap extends over the lower slide flap and fastens the lower slide flap in place.

4. The slide system of claim 1, wherein the restraint structure is a flexible sheet that is sewn on one edge to the lower slide support of the base inflatable structure, and an opposing edge includes the fastener for fastening the restraint structure to the lower slide support of the base inflatable structure.

5. A slide system comprising:

a base inflatable structure capable of sustaining an air pressure;

a slide surface supported by the base inflatable structure, the slide surface having a top end and extends on an incline to a bottom end, and is constructed of a material that has a coefficient of friction that is suitable for sliding;

a lower slide flap that is separate from the base inflatable structure and forms the bottom end of the slide surface;

a lower slide support of the base inflatable structure that is shaped to support the lower slide flap;

a bumper body that is adapted to receive air pressure from the base inflatable structure to inflate to form a protrusion that extends upwardly from the lower slide support when inflated, but which is flexible enough to be collapsed to a flattened configuration; and a restraint structure that contains the bumper body in the flattened configuration, but which is adapted to be released to allow the bumper body to inflate to form the protrusion.

6. The slide system of claim 5, further comprising lower side edge fasteners for removably connecting side edges of the lower slide flap to the lower slide support of the base inflatable structure.

7. The slide system of claim 5, further comprising upper side edge fasteners for removably connecting side edges of the lower slide flap to a locking flap that is pivotally connected to the lower slide support of the base inflatable structure, such that the locking flap extends over the lower slide flap and fastens the lower slide flap in place.

8. The slide system of claim 5, wherein the restraint structure is a flexible sheet that is sewn on one edge to the lower slide support of the base inflatable structure, and an opposing edge includes the fastener for fastening the restraint structure to the lower slide support of the base inflatable structure.

9. A method for raising bumper at a bottom end of a slide to prevent a user from sliding off the end of the slide, the method comprising the steps of:

providing a slide system comprising:

a base inflatable structure capable of sustaining an air pressure;

a slide surface supported by the base inflatable structure, the slide surface having a top end and extends on an incline to a bottom end, and is constructed of a material that has a coefficient of friction that is suitable for sliding;

a lower slide flap that is separate from the base inflatable structure and forms the bottom end of the slide surface;

a lower slide support of the base inflatable structure that is shaped to support the lower slide flap;

an aperture in the lower slide support, beneath the bottom end of the slide surface; and a bumper body positioned over the aperture to receive the air pressure from the base inflatable structure;

fastening the bumper body into the flattened configuration;

inflating the base inflatable structure such that the slide surface is supported upon the base inflatable structure, but wherein the bumper body remains deflated and the slide surface remains unobstructed by the bumper body; and releasing the bumper body so that the bumper body receives air from the base inflatable structure and inflates, pushing the slide surface upwardly by the protrusion of the bumper body.

* * * * *